United States Patent [19]

Bentley et al.

[11] 3,974,624

[45] Aug. 17, 1976

[54] APPARATUS FOR DISTRIBUTING ARTICLES INTO RECEPTACLES

[75] Inventors: John Richard Bentley, Bristol; Simon Foley, London, both of England

[73] Assignee: Auto Egg (Bristol) Limited, Bristol, England

[22] Filed: Aug. 22, 1974

[21] Appl. No.: 499,680

[30] Foreign Application Priority Data

Aug. 25, 1973 United Kingdom ..... 40381/73
Oct. 24, 1973 United Kingdom ..... 49574/73

[52] U.S. Cl. ..... 53/160; 53/166; 53/246

[51] Int. Cl.[2] ..... B65B 35/32

[58] Field of Search ..... 53/246, 247, 248, 166, 53/61, 160, 255, 261, 252, 235, 59 R

[56] References Cited

UNITED STATES PATENTS

| | | | |
|---|---|---|---|
| 2,656,656 | 10/1953 | Murdoch et al. | 53/61 |
| 2,993,622 | 7/1961 | Mumma | 53/246 X |
| 3,118,548 | 7/1964 | Bliss et al. | 53/246 UX |
| 3,126,993 | 3/1964 | Van Der Schoot | 53/246 UX |
| 3,169,354 | 2/1965 | Bliss et al. | 53/61 |
| 3,193,980 | 7/1965 | Mumma | 53/160 X |
| 3,220,154 | 11/1965 | Van Der Schoot | 53/246 X |
| 3,611,673 | 10/1971 | Carkhuff | 53/59 R |

*Primary Examiner*—Travis S. McGehee
*Assistant Examiner*—Horace M. Culver
*Attorney, Agent, or Firm*—Sughrue, Rothwell, Mion, Zinn & Macpeak

[57] ABSTRACT

Articles, particularly eggs, are conveyed after grading along a moving cup conveyor from which they are selectively deposited at different loading stations according to size. At each loading station the eggs are dropped into different pockets of a collator which is held closed until all its pockets have been filled, when the collator is opened by a cam-released linkage to allow all the eggs in the collator pockets to fall simultaneously into a receptacle resting on a spring impact-resisting platform.

8 Claims, 3 Drawing Figures

II
8a
6
C
E
25
22
21
2
3
4
5
1
19
17
18
16
10

9a
24
23
7a
26
8b
25
7b
9b
8a
22

APPARATUS FOR DISTRIBUTING ARTICLES INTO RECEPTACLES

This invention relates to the handling of articles, particularly fragile articles such as eggs, and the distribution of such articles into trays, cartons, or other packages.

Machines are already known, as described in British Pat. Nos. 875797 and 889668, for grading articles such as eggs according to weight and distributing the graded articles to trays, cartons, cases or other packaging receptacles. In the apparatus used to distribute the graded articles to the packaging receptacles the graded articles are carried by a conveyor in individual cups and are released automatically from each cup by an individual release mechanism which is operated by a stored signal derived from the grading station. Thus the cups on the conveyor release the articles individually into the receptacles, which are in turn moved into position beneath the cups on separate conveyors.

The present invention provides an improved apparatus for distributing articles for use with grading machines of the kind referred to above, capable potentially of increasing the speed of distribution and therefore of packing of the articles.

SUMMARY OF THE INVENTION

According to the invention there is provided an apparatus for distributing articles such as eggs into receptacles, comprising a group of pockets adapted to receive individual articles from a moving conveyor, the pockets being disposed directly above at least one platform for receiving one or more receptacles and a release mechanism controlled so as to be operated automatically when the pockets of the group are full to open the pockets simultaneously so that in use of the apparatus the articles in the pockets of the group fall simultaneously into a receptacle or receptacles on the platform or platforms.

The associated grading machine with which the apparatus of the present invention co-operates will be arranged in practice to distribute the graded articles, for example eggs graded according to their weight, into the pockets of each group. The articles can be delivered at high speed to the pockets of the distributing apparatus, utilising grading machines of the kind referred to above, in which articles are released from respective cups of the moving conveyor automatically according to the grading of the articles, so that only articles of a specific grade are deposited in the pockets of a given said group.

The group of pockets may be defined between a pair of walls which are pivotable about horizontal parallel axes and which are movable relatively to each other about said axes between open and closed positions of the pockets. The two walls are preferably held in the closed position by a toggle linkage which is releasable by a lever mechanism under control of a cam. The control cam may be located in or driven by a sorting and distributing unit which causes the cam to release the toggle linkage only when all the pockets in the apparatus have been filled with articles.

Where fragile articles such as eggs are to be distributed the pockets of the apparatus may be formed by resilient shaped inserts attached to the inwardly facing surfaces of the pivoted walls, the inserts having a shape and size conforming to the shape of the articles to be retained in the pockets, and being preferably detachable from the respective pivoted walls.

Preferably the walls are moved apart positively by a cam or other means so that they separate at a predetermined substantially uniform speed. In a preferred embodiment the pocket-defining walls converge towards each other in a downward direction, so that upon opening of the pockets the convergence of the walls is reduced or eliminated to allow articles in the pockets, especially where these are ovoidal in shape, to move progressively downwardly through the respective pockets before being finally released. In this way the vertical impact of the articles on the waiting receptacles is lessened.

Even with this provision, however, the apparatus according to the invention releases several articles simultaneously into the waiting receptacle or receptacles and there is in consequence necessarily a considerable impact to be absorbed by the receptacles. Unless this impact is cushioned, there is a risk either of breaking the articles, where these are fragile, or of causing the articles to rebound from the receptacles and thereby become displaced or broken, particularly where the receptacles are made of resilient material such as plastics.

According therefore to a preferred embodiment of the invention the or each platform is supported by resilient mountings which are effective to absorb the shock resulting from the impact of the articles on a respective receptacle supported on the platform when the articles fall into the receptacle from the pockets of the apparatus. The resilient mountings preferably comprise or incorporate resilient foam members of, for example, plastics or synthetic rubber.

BRIEF DESCRIPTION OF THE DRAWINGS

An embodiment of the invention will now be described, merely by way of example, with reference to the accompanying drawings, in which.

DESCRIPTION OF THE ILLUSTRATED EMBODIMENT

Figure 1:
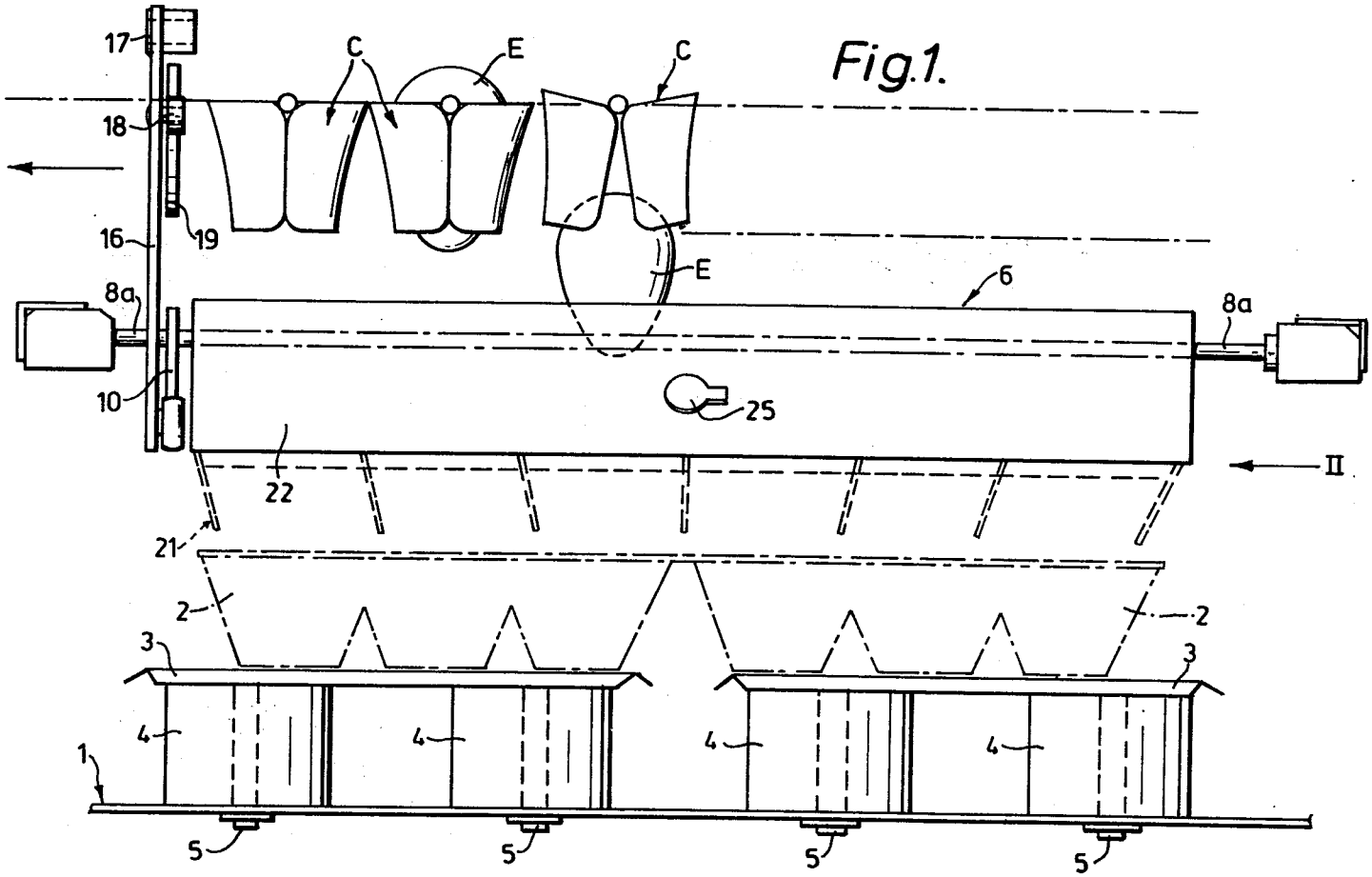
FIG. 1 illustrates diagrammatically an apparatus according to one embodiment of the invention in side elevation.

Referring to the drawings, there is shown part of an egg grading and packing machine including an egg weighing and grading station for grading eggs according to their weight, as described in British patent specifications Nos. 875797 and 889668. Eggs E graded according to weight are placed in individual cups C carried by a continuously driven chain conveyor, part only of which is shown, the cups C moving in a linear path above and parallel to a horizontal table 1 on which open receptacles 2 to be filled (shown in dotted outline) are resiliently supported, as hereinafter described in further detail.

The receptacles 2 in the illustrated example comprise individual cartons of fibrous or plastics material, each formed with six moulded pockets to receive six eggs. The apparatus according to this embodiment is arranged to fill two of these receptacles 2 simultaneously, and to this end the two receptacles 2 are arranged side by side on separate flat horizontal platforms 3 which are independently supported from the table 1 by resilient mounting members 4 in the form of hollow cylinders of elastomeric material or synthetic plastics foam arranged with their axes vertical. Respective vertical posts 5 attached to the table 1 extend through the bores of the respective support members 4 and restrain the platforms 3 against horizontal displacement, while the mounting members 4 permit vertical displacement of the platforms 3 so that the receptacles 2 are in effect resiliently supported by the respective platforms 3. In the illustrated example each platform 3 is supported by three resilient mounting members 4.

Successive empty receptacles 2 are advanced onto the platforms 3 in the direction of arrow A (FIG. 2) until one empty row of egg-receiving pockets in each receptacle 2 — that is, six pockets in all — are aligned with and arranged directly beneath a collator device 6 forming part of the apparatus according to the invention. To avoid the tendency for receptacles 2 to slide on the surface of the platforms 3 when "shunted" by the following receptacles the surfaces of the platforms 3 are preferably of a non-slip character — for example a plastics or fabric surface layer.

The collator device 6 is arranged to receive six eggs, graded into a given category according to weight, from individual cups C of the overhead moving conveyor (not shown) leading from the sorting station as described previously. Each cup C of the conveyor is of a known type formed by two hinged doors pivotable about a common horizontal axis. Each cup C is closed prior to its arrival at the sorting station where it receives an egg E which has been graded according to weight. The cup C is subsequently opened by the operation of a switch, controlled by the sorting station, when the cup reaches the collator device appropriate to the graded category of the egg in the cup. The switch energises a solenoid associated with the collator device 6 to cause a latch release cam (not shown) to advance and release a latch on the cup, opening the latter and releasing the egg into the collator device, as illustrated diagrammatically by one of the cups C shown in FIG. 1.

The collator device 6 comprises two flat metal walls 7*a*, 7*b* which are pivotable about respective horizontal parallel axes defined by respective shafts 8*a*, 8*b* attached to the outside of the respective walls. Resilient moulded inserts 9*a*, 9*b* are releasably attached to the inwardly facing surfaces of the two pivoted walls 7*a*, 7*b* which act as rigid backing plates, the inserts 9 being so shaped that between them they define six pockets for receiving individual eggs E from the overhead cup conveyor. The inserts 9 may be moulded from rubber, synthetic rubber or other resilient material. The six pockets formed by the resilient inserts 9 are aligned vertically with the respective egg-receiving pockets in the receptacles 2 to be filled.

Figure 2:
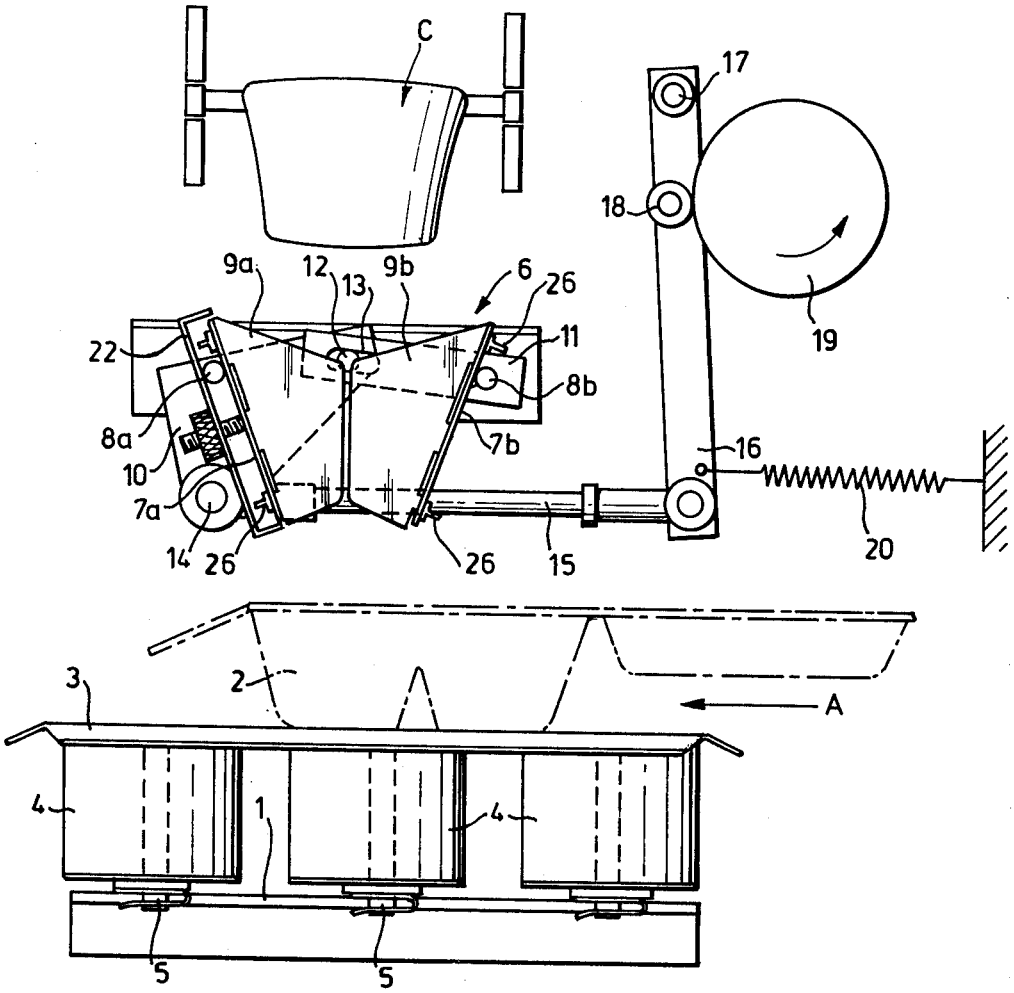
FIG. 2 is a diagrammatic view of the apparatus of FIG. 1 in end elevation, viewed in the direction of arrow II in FIG. 1.

The two pivoted walls 7*a*, 7*b* are normally held in a closed position shown in FIG. 2, in which surfaces of the resilient inserts 9 between the individual egg pockets abut each other and in which eggs are retained in the pockets. The two pivoted walls 7*a*, 7*b* are interconnected at one end by a lever linkage formed by a master lever 10 fixed to one end of one of the shafts 8*a* and a slave lever 11 fixed to one end of the other shaft 8*b*, the master lever 10 carrying a pin 12 which engages in a slot 13 formed at one end of the slave lever 11.

The master lever 10, which is triangular in shape (FIG. 2), is mounted for rotation with the respective shaft 8*a* about the axis of the latter and is pivotally connected at a pivot pin 14 spaced from the shaft 8*a* and the pin 12 to one end of a connecting rod 15 of adjustable length, the other end of the connecting rod 15 being pivotally connected to a cam follower lever 16. The cam follower lever 16 is pivotable about a horizontal shaft 17 at its upper end and intermediate its ends the lever 16 carries a freely rotatable cam follower roller 18 which rests against the surface of a rotatable release control cam 19.

The control cam 19 is advanced in the direction indicated by the arrow in FIG. 2 by successive steps each time the latch release cam is advanced, the profile of the cam 19 being such that when all the pockets (six in this example) of the collator device 6 have been filled with eggs, that is, immediately an egg is released into the last (sixth) empty pocket of the collator device 6, the control cam 19, acting through the lever 16, causes the connecting rod 15 to be displaced to the left (as viewed in FIG. 2). This causes the master lever 10 to be rotated in a clockwise direction (as viewed in FIG. 2) about the axis of the respective shaft 8*a*, and, by virtue of the pin and slot connection 12, 13, causing a corresponding anti-clockwise rocking movement of the slave lever 11 about the axis of its shaft 8*b*. Thus the two shafts 8*a*, 8*b* rotate by equal amounts in opposite directions, and cause the two walls 7*a*, 7*b* of the collator device to rotate by equal amounts in opposite directions so as to move the lower edges of the walls 7 away from each other, thereby allowing eggs located in the respective pockets of the collator device 6 to fall from these pockets into the pockets of the waiting empty receptacles 2. The return or closing movement of the walls of the collator device is controlled by the profile of the cam 19 and follows rapidly under the action of a return spring 20 (FIG. 2) acting on the cam follower lever 16. The spring 20 holds the roller 18 in permanent engagement with the surface of the cam 19.

The timing of each release of eggs from the collator device 6 is controlled solely by the cam 19, and is such that eggs are released only when all the pockets in the collator device 6 have been filled.

The simultaneous release of eggs from the collator device 6 into the receptacles 2 results in a considerable vertical impact on the respective supporting platforms 3. This impact is effectively absorbed by the resilient mounting members 4 of the platforms 3, so that the tendency for the eggs to bounce out of the receptacles 2 is effectively eliminated, and the risk of cracking of the eggs minimized. Immediately the six eggs have been released from the collator device 6 and deposited into the row of pockets in the waiting receptacles 2, the latter are advanced automatically in the direction A by one inter-pocket spacing to bring the next row of receptacle pockets into vertical alignment with the pockets of the collator device 6 for filling from the latter as described previously. The automatic advance of the receptacles 2 may conveniently be controlled by the cam 19.

Instead of employing resilient shock-absorbing mountings for the or each receptacle platform, the latter may be arranged for limited vertical movement, for example under control of a cam, whereby the platform is caused to move downwardly during the release of articles into the receptacle carried by the platform, so that the impact speed of the articles is reduced.

The illustrated embodiment of the invention is adapted for the distribution of eggs into six-pocket receptacles. The same collator device 6 can also be used for distributing eggs into trays of the Keyes type. For this purpose it may be found advantageous to use a discharge grille device 21, illustrated in broken outline in FIG. 1, comprising a number of plastics vanes for guiding the individual eggs as they leave the pockets of the collator device 6 into the pockets of the tray.

Figure 3:
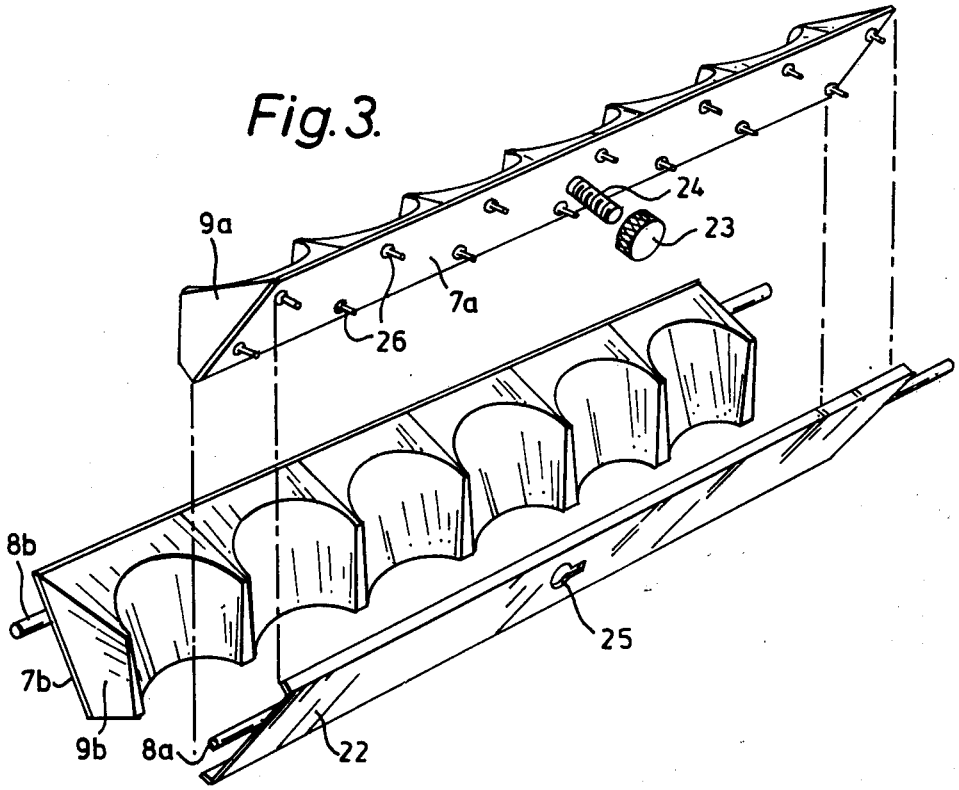
FIG. 3 is a diagrammatic perspective view of the collator device in the apparatus of FIGS. 1 and 2, shown partly disassembled.

To facilitate cleaning of the collator device 6 the pivoted wall 7*a* which is remote from the control cam 19 is releasably attached to a sheet metal housing 22 by a milled nut 23 threaded on a stud 24 attached to the wall 7*a* and passing through a keyhole aperture 25 in the housing 22 so that the wall 7*a* with its insert 9*a* attached may be lifted out for cleaning purposes (FIG. 3) while at the same time affording access to the other, non-removable, insert 9*b*.

Each insert 9*a*, 9*b* is moulded in sections which are individually and releasably attached to the respective walls 7*a*, 7*b* by the fitting of integral buttons or nipples 26 in respective holes in the walls 7*a*, 7*b*, each nipple having an enlarged portion which abuts the outside face of the respective wall.

We claim:

1. In a packing machine having a horizontally moving conveyor, an apparatus for distributing articles, such as eggs, from the moving conveyor into receptacles comprising: at least one platform disposed below said conveyor for supporting at least one receptacle having multiple compartments for receiving the individual articles from the horizontally moving conveyor; a stationary collator disposed above the platform between the platform and the moving conveyor, the collator comprising a pair of walls, means defining a group of pockets between said collator walls for receiving the individual articles from the conveyor, the pockets being spaced apart in a direction parallel to the direction of movement of the conveyor; means supporting said collator walls for pivotal movement about horizontal parallel pivot axes; a housing supported for pivotal movement about a horizontal axis; means releasably connecting one of said pocket-defining walls to said housing; a release mechanism means connected to the collator to cause relative pivotal separation of the walls to release the individual articles therefrom; and, means controlling the release mechanism to operate the latter automatically when the articles are located in all the pockets of the group thereby, releasing the articles from all of said pockets of the group simultaneously so as to fall from the collator into respective receptacle compartments.

2. The apparatus defined in claim 1, wherein said platform has resilient mounting means effective to absorb the shock resulting from the impact of articles dropped from the pockets into the respective receptacle in use of the apparatus.

3. The apparatus defined in claim 2, wherein the resilient mountings comprise resilient foam members.

4. The apparatus defined in claim 1, wherein the release mechanism means comprises a toggle linkage connected to the two pivotally mounted walls and a cam-controlled lever mechanism acting on the toggle linkage to release the latter at a predetermined position of the cam.

5. The apparatus defined in claim 1, wherein the pockets are formed by resilient foam inserts attached to the inwardly facing surfaces of the pivoted walls.

6. The apparatus defined in claim 1, including positive-acting cam means connected to the pocket-defining walls to separate said walls at a substantially uniform speed upon opening of the pockets.

7. The apparatus defined in claim 1, wherein the pocket-defining walls converge towards each other in a downward direction and in the open condition of the pockets the convergence of the walls is reduced to allow articles in the pockets to move progressively downwardly through the pockets upon their release therefrom.

8. In a packing machine having a hoirzontally moving conveyor, an apparatus for distributing articles, such as eggs, from the moving conveyor into receptacles comprising: at least one platform disposed below said conveyor for supporting at least one receptacle having multiple compartments for receiving the individual articles from the horizontally moving conveyor; a stationary collator disposed above the platform between the platform and the moving conveyor, the collator comprising a pair of walls which converge towards each other in a downward direction, means defining a group of pockets between said collator walls for receiving the individual articles from the conveyor, the pockets being spaced apart in a direction parallel to the direction of movement of the conveyor; means supporting said collator walls for pivotal movement about horizontal parallel pivot axes; positive-acting cam means connected to the pocket-defining walls to separate said walls at a substantially uniform speed upon opening of the pockets to cause the downward convergence of the pocket-defining walls to be reduced, allowing the individual articles in the pockets to move progressively downwardly through the pockets upon their release therefrom; and, means controlling the cam means to operate the latter automatically when the articles are located in all the pockets of the group thereby, releasing the articles from all of said pockets of the group simultaneously so as to fall from the collator into respective receptacle compartments.

* * * * *